US008313317B2

(12) United States Patent
Yamazaki et al.

(10) Patent No.: US 8,313,317 B2
(45) Date of Patent: Nov. 20, 2012

(54) SCROLL FLUID MACHINE WITH COLD FORGED ECCENTRIC CRANKSHAFT

(75) Inventors: Hiroshi Yamazaki, Aichi (JP); Makoto Takeuchi, Aichi (JP); Tetsuzou Ukai, Aichi (JP); Kazuhide Watanabe, Aichi (JP); Tomohisa Moro, Aichi (JP); Katsuhiro Fujita, Aichi (JP); Takayuki Kuwahara, Aichi (JP); Takamitsu Himeno, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 841 days.

(21) Appl. No.: 12/516,654

(22) PCT Filed: Nov. 29, 2007

(86) PCT No.: PCT/JP2007/073038

§ 371 (c)(1), (2), (4) Date: May 28, 2009

(87) PCT Pub. No.: WO2008/066104

PCT Pub. Date: Jun. 5, 2008

(65) Prior Publication Data

US 2010/0068086 A1 Mar. 18, 2010

(30) Foreign Application Priority Data

Nov. 29, 2006 (JP) ..... 2006-322311

(51) Int. Cl.

| | |
|---|---|
| ***F01C 1/02*** | (2006.01) |
| ***F01C 1/063*** | (2006.01) |
| ***F04C 2/02*** | (2006.01) |
| ***F04C 2/063*** | (2006.01) |

(52) U.S. Cl. ..... 418/55.1

(58) Field of Classification Search ..... 418/55.1
See application file for complete search history.

(56) References Cited

U.S. PATENT DOCUMENTS 5,199,859 A * 4/1993 Kitaichi ..... 417/410.1
(Continued)

FOREIGN PATENT DOCUMENTS

JP 06-288360 A 10/1994
(Continued)

OTHER PUBLICATIONS

International Search Report for PCT/JP2007/073038 mailed on Jan. 15, 2008.

*Primary Examiner* — Mary A Davis
(74) *Attorney, Agent, or Firm* — Westerman, Hattori, Daniels & Adrian, LLP

(57) ABSTRACT

Provided is a scroll fluid machine that, by using a crankshaft manufactured by cold forging and a needle bearing, can sufficiently exhibit the performance of a variable circling radius mechanism, can provide a sufficient reliability on a bearing portion of the crankshaft, and can be manufactured inexpensively. For this purpose, in a crankshaft 60 used for a driving force transmission system, a reinforced shaft unit 63 and a circular column-like large diameter unit 61 are formed at an end of a rotating shaft 16, a material is produced by a cold forging process so that an eccentric shaft 62 projects from the circular column-like large diameter unit 61, the circular column-like large diameter unit 61 is rotatably coupled to a housing 11 via a needle bearing 64, and the variable circling radius mechanism is stably operated with rigidity increased by the reinforced shaft unit 63.

3 Claims, 3 Drawing Sheets

U.S. PATENT DOCUMENTS

| | | | | |
|---|---|---|---|---|
| 7,217,109 | B2 * | 5/2007 | Takei | 418/55.3 |
| 7,604,465 | B2 * | 10/2009 | Fujita et al. | 418/55.1 |
| 2002/0057977 | A1 | 5/2002 | Fujita et al. | |
| 2004/0261918 | A1 * | 12/2004 | Ando et al. | 148/649 |
| 2005/0207926 | A1 * | 9/2005 | Nishiwaki et al. | 418/55.2 |
| 2006/0171830 | A1 * | 8/2006 | Takei | 418/55.1 |

FOREIGN PATENT DOCUMENTS

| | | | |
|---|---|---|---|
| JP | 08-001269 | A | 1/1996 |
| JP | 08-121357 | A | 5/1996 |
| JP | 9-105390 | A | 4/1997 |
| JP | 2001-082358 | A | 3/2001 |
| JP | 2002-147361 | A | 5/2002 |
| TW | 506864 | A * | 10/2002 |

* cited by examiner

SCROLL FLUID MACHINE WITH COLD FORGED ECCENTRIC CRANKSHAFT

TECHNICAL FIELD

The present invention relates to a scroll fluid machine used as a compressor, an expander, a fluid pump, or the like.

BACKGROUND ART

In general, scroll fluid machines include a scroll compressor that compresses a gaseous refrigerant used for a vehicle air conditioner or the like.

In the scroll compressor, a compressing unit accommodated in a housing is formed by joining a fixed scroll in which a spiral wall body is set at one side of an end plate, and a circling scroll in which a spiral wall body is formed in substantially the same shape as that of the wall body of the fixed scroll is set at one side of an end plate.

In the compressing unit of the scroll compressor, a compression chamber is defined by making the side surfaces of the spiral wall bodies of the joined fixed scroll and the circling scroll come into linear contact with each other. The compression chamber is formed so that it can gradually move in the center direction of the spiral with the circling scroll revolving to circle and prevented from rotating.

In other words, in the scroll compressor, by making the circling scroll prevented from rotating revolve to circle around the fixed scroll, the volume of the compression chamber formed between the wall bodies is gradually reduced, thereby compressing the gas in the compression chamber.

In the conventional scroll compressor, a variable circling radius mechanism (such as a slidable variable circling radius mechanism) is used as a gap seal in a radial direction to eliminate a gap between scroll teeth.

The variable circling radius mechanism is formed at a part of the mechanism used to make the circling scroll revolve to circle.

In the variable circling radius mechanism, a driving bush is rotatably mounted in a boss provided at the side of a circle side end plate of the circling scroll via a bearing. In the variable circling radius mechanism, a slide hole elongated in a predetermined direction is formed at an end surface of the driving bush.

A balance weight that cancels an unbalance amount generated when the circling scroll is revolved to circle is fitted to the driving bush.

In the circling scroll, a crankshaft used to transmit a driving force that makes the circling scroll revolve to circle to the driving bush is mounted on a scroll compressor main body.

The crankshaft includes a rotating shaft to which the driving force is entered, and an eccentric shaft projecting from a position eccentric by a predetermined amount from the end of the rotating shaft. By slidably inserting the eccentric shaft into the slide hole of the driving bush, the crankshaft is mounted so as to transmit the driving force.

In the scroll compressor formed in this manner, in conjunction with the movement to revolve the eccentric shaft by rotating and driving the rotating shaft, via the driving bush to which the eccentric shaft is rotatably coupled and a boss linked to the driving bush via a bearing, the circling scroll integrated with the boss revolves to circle.

When the scroll compressor compresses gas, a moment due to the reaction of gas pressure generated when gas is compressed, and a moment due to the centrifugal force of members such as the circling scroll and the balance weight are applied to the eccentric shaft.

Accordingly, in the variable circling radius mechanism of the scroll compressor, by using a vector component of the centrifugal force and the gas pressure force, the circling scroll is moved in a direction (direction in which scroll teeth come close to each other and eliminate a gap) to increase the circling radius, when a driving center of the circling scroll (center of the bearing for the driving bush fitted into a boss hole of the circling scroll) is circled. Subsequently, air tightness is maintained by pushing the circling scroll to the fixed scroll (for example, refer to Patent Document 1).

The variable circling radius mechanism used for the scroll compressor formed in this manner has characteristics that the function of the variable circling radius mechanism can be sufficiently exhibited and the performance thereof can be improved, with the increase of an eccentric amount between the rotating shaft and the eccentric shaft of the crankshaft.

In view of manufacturing a crankshaft to be used here, for example, it is suggested that the crankshaft be manufactured by a compression molding method. In the compression molding method, a plurality of compression molding stations provided with dies and punches for compression molding are prepared, and while delivering a material of the crankshaft across the compression molding stations, the material of the crankshaft is processed by step-by-step cold forging.

In the compression molding method of the crankshaft, at a first step, a main shaft unit with a small diameter is drawn at one end of a material of the crankshaft, and a circular column-like large diameter unit with a predetermined length is formed at the other end of the material.

At a second step, while maintaining the main shaft unit with a die, at a portion eccentric from the main shaft unit at an end surface opposite to the main shaft unit of the large diameter unit, an eccentric shaft unit is formed by punching.

At a third step, while maintaining the eccentric relationship between the two shaft units, the large diameter unit is deformed in a flattening direction, thereby completing the crankshaft (for example, refer to Patent Document 2).

When the crankshaft is manufactured by the compression molding method as described above, it can be manufactured inexpensively. However, if the crankshaft is manufactured by the compression molding method, an increase in the eccentric amount between the rotating shaft and the eccentric shaft is limited in terms of processing.

For this reason, when the eccentric amount between the rotating shaft and the eccentric shaft exceeds the processing limit, not cold forging but hot forging process is applicable for the manufacturing.

When the crankshaft is processed by hot forging, the yield of the product deteriorates due to the occurrence of burr, for example. Accordingly, the manufacturing cost increases, thereby increasing the product cost of the crankshaft.

In the conventional scroll compressor, to rotatably receive the crankshaft, the circular column-like large diameter unit formed between the rotating shaft and the eccentric shaft of the crankshaft is supported by a ball bearing.

Subsequently, in the scroll compressor, when the circling scroll is revolved to circle by the crankshaft, the ball bearing is used to support the crankshaft to prevent the crankshaft from receiving damage. The crankshaft receives damage because the crankshaft is deflected and deformed by an eccentric load applied to the eccentric shaft of the crankshaft, and makes the outer peripheral end of the circular column-like large diameter unit incline and slide. However, ball bearings are expensive.

[Patent Document 1] Japanese Patent Application Laid-open No. H9-105390

[Patent Document 2] Japanese Patent Application Laid-open No. H8-1269

DISCLOSURE OF INVENTION

Problem to be Solved by the Invention

Conventionally, there has been a demand for manufacturing an inexpensive scroll compressor.

However, in the scroll compressor, when a crankshaft manufactured inexpensively by cold forging is employed, the eccentric amount between the rotating shaft and the eccentric shaft is reduced. This makes it difficult to sufficiently guarantee the variable circling radius mechanism to function as a gap seal in a radial direction to eliminate a gap between the scroll teeth. This is because the friction moment around the eccentric shaft that prevents the drive of the variable circling radius mechanism is large. Accordingly, if the eccentric amount is small, the driving moment is reduced and a sufficient pushing force cannot be obtained.

If an expensive ball bearing used to support the circular column-like large diameter unit of the crankshaft is replaced with an inexpensive needle bearing, a problem occurs in that the crankshaft may be deflected, thereby coming into partial contact with a portion of the needle bearing and being damaged. Accordingly, the reliability on the bearing portion of the crankshaft is decreased.

However, there has been no scroll compressor that, by using an inexpensive crankshaft manufactured by cold forging and an inexpensive needle bearing, sufficiently guarantees the performance of the variable circling radius mechanism, and maintains the reliability on the bearing portion of the crankshaft, by preventing the crankshaft from being deflected, coming into partial contact with the portion of the needle bearing, and being damaged.

The present invention has been made in view of the above circumstances, and intended to provide a new scroll fluid machine that, by using a crankshaft manufactured by cold forging and a needle bearing, can sufficiently exhibit the performance of a variable circling radius mechanism, can provide a sufficient reliability on a bearing portion of the crankshaft, and can be manufactured inexpensively.

Means for Solving Problem

According to an aspect of the present invention, a scroll fluid machine includes: a crankshaft that makes a circling scroll revolve to circle around a fixed scroll fixed inside a housing; and a variable circling radius mechanism that, by pushing the circling scroll to the fixed scroll, seals a compression chamber defined by the fixed scroll and the circling scroll in a radial direction. A reinforced shaft unit with a large shaft having a predetermined diameter is provided continuously at a driving device side of a circular column-like large diameter unit of the crankshaft, and a material is produced by a step-by-step cold forging process by setting an eccentric shaft projecting from a shaft center of a rotating shaft in the circular column-like large diameter unit at a predetermined eccentricity ratio f, the circular column-like large diameter unit of the crankshaft is rotatably coupled to the housing via a needle bearing, and the predetermined diameter of the reinforced shaft unit is set so that a deflection amount towards a side of the eccentric shaft, while transmitting a driving force by the crankshaft, falls within an acceptable range to stably operate the variable circling radius mechanism.

Advantageously, in the scroll fluid machine, the eccentricity ratio f of the crankshaft is calculated by a following formula, and the eccentricity ratio f is set to $1 \leqq f \leqq 2$:

$f=r/L$, where:

$$L=\sqrt{\epsilon^2-\rho^2\cos^2\alpha}-\rho\sin\alpha \qquad \text{[Expression 1]}$$

where f indicates the eccentricity ratio of the eccentric shaft, r indicates a radius of the eccentric shaft, L indicates a distance between a center of and a driving center of the eccentric shaft, $\epsilon$ indicates an eccentric amount of the eccentric shaft, $\rho$ indicates a circling radius, and $\alpha$ indicates an angle at which the eccentric shaft is set.

With the arrangement described above, an inexpensive product can be provided by producing a crankshaft inexpensively using a cold forging process, and by forming a scroll fluid machine in which a circular column-like large diameter unit of the crankshaft is rotatably coupled to the housing via a large and inexpensive needle bearing. By providing a reinforced shaft unit to the crankshaft, it is possible to prevent the eccentric amount of an eccentric shaft from decreasing and prevent the function of the variable circling radius mechanism as a gap seal in the radial direction from reducing, caused by a cold forging process. It is also possible to mitigate partial contact, caused because the needle bearing is used for pivotal coupling.

Advantageously, in the scroll fluid machine, the crankshaft is produced by a cold forging process using SCM415 steel.

With the arrangement described above, in addition to the operational advantages of the invention, it is possible to inexpensively manufacture the crankshaft at a high yield, by a cold forging process.

Advantageously, the scroll fluid machine, the crankshaft is produced by a cold forging process using a round bar-like material that has a same diameter as the diameter of the reinforced shaft unit.

With the arrangement described above, in addition to the operational advantages of the invention, because the round bar-like material has the same diameter as the diameter of the reinforced shaft unit, when the round bar-like material is applied with the cold forging, the round bar-like material itself can be formed into the reinforced shaft unit. Accordingly, number of the processes for the cold forging is reduced, thereby reducing a manufacturing cost.

Effect of the Invention

A scroll fluid machine according to the present invention provides advantages that the performance of a variable circling radius mechanism can be sufficiently exhibited by using a crankshaft manufactured by cold forging, a sufficient reliability on a bearing portion of the crankshaft can be achieved by using a needle bearing, and the scroll fluid machine can be manufactured inexpensively.

EXPLANATIONS OF LETTERS OR NUMERALS

Figure 1:
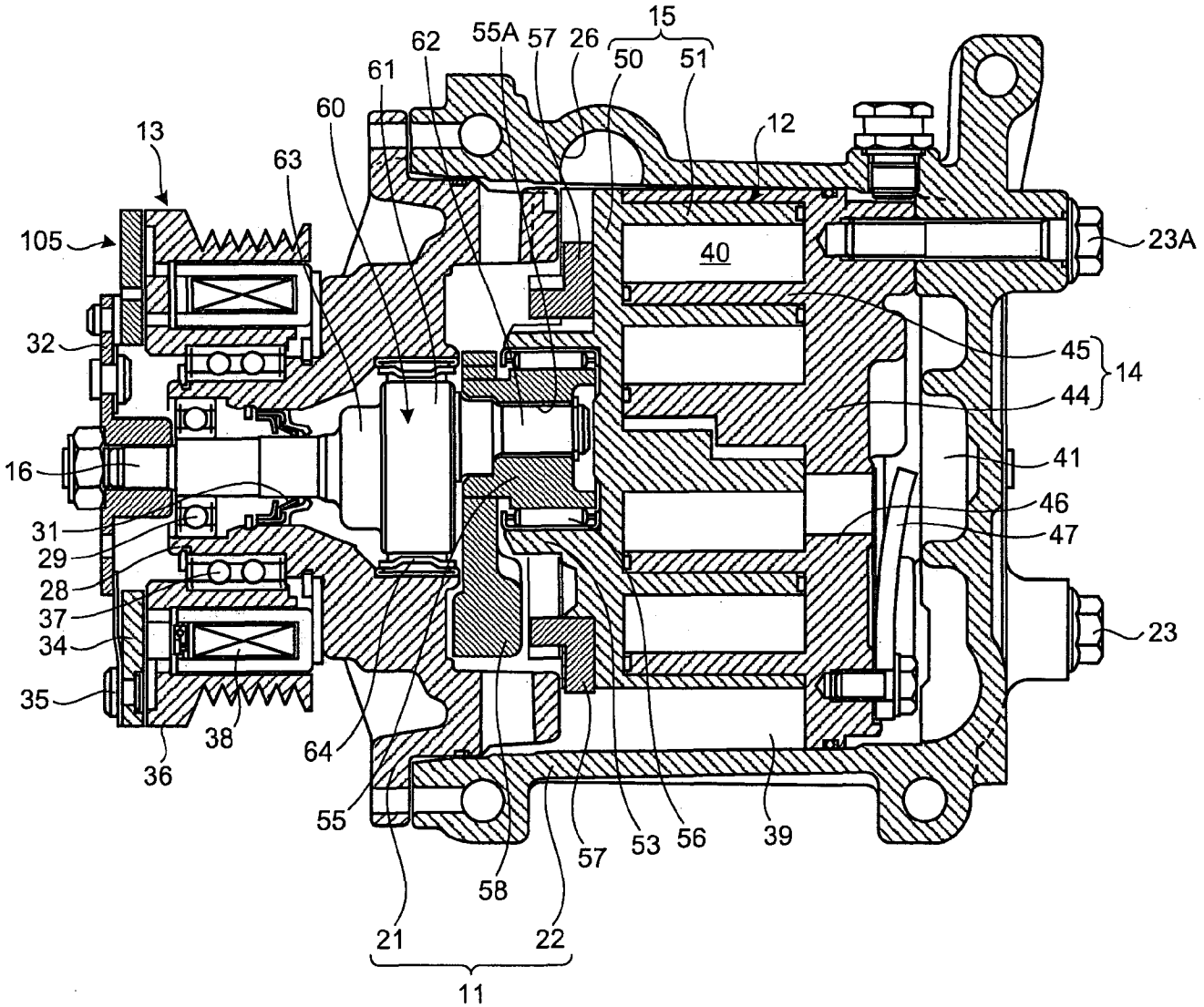
FIG. 1 is an overall sectional view of a scroll compressor of a scroll fluid machine according to an embodiment of the present invention.

1 scroll compressor main body
11 housing
12 compressing unit
13 driving device
14 fixed scroll
15 circling scroll
16 rotating shaft
60 crankshaft
61 circular column-like large diameter unit
62 eccentric shaft
63 reinforced shaft unit
64 needle bearing

BEST MODE(S) FOR CARRYING OUT THE INVENTION

Exemplary embodiments of a scroll fluid machine according to the present invention are described below in detail with reference to the accompanying drawings.

FIG. 1 is a sectional view of a scroll compressor according to an embodiment of the present invention. In the view, 1 indicates a scroll compressor main body. The scroll compressor main body 1, for example, is used to compress a gaseous refrigerant used for a vehicle air conditioner.

The scroll compressor main body 1 includes a housing 11, a compressing unit 12 accommodated in the housing 11, and a driving device 13 that drives the compressing unit 12. The compressing unit 12 includes a fixed scroll 14 and a circling scroll (circling member) 15.

The driving device 13 is formed to transmit a driving force to make the circling scroll 15 of the compressing unit 12 revolve to circle via a crankshaft 60, a driving bush 55, and the like.

The housing 11 is formed as a sealed container in a substantially cylindrical shape that covers the entire scroll compressor, by integrally assembling a front case 21 and a rear case 22. The front case 21 and the rear case 22 are integrated, by having opening portions joined to each other and by being fastened with a plurality of housing bolts 23.

The front case 21 is formed in a substantially cylindrical shape, and a supporting unit 28 in a ring shape reduced in diameter is formed at the end. The crankshaft 60 is rotatably mounted in the tube-like inside of the supporting unit 28 of the front case 21.

Figure 4:
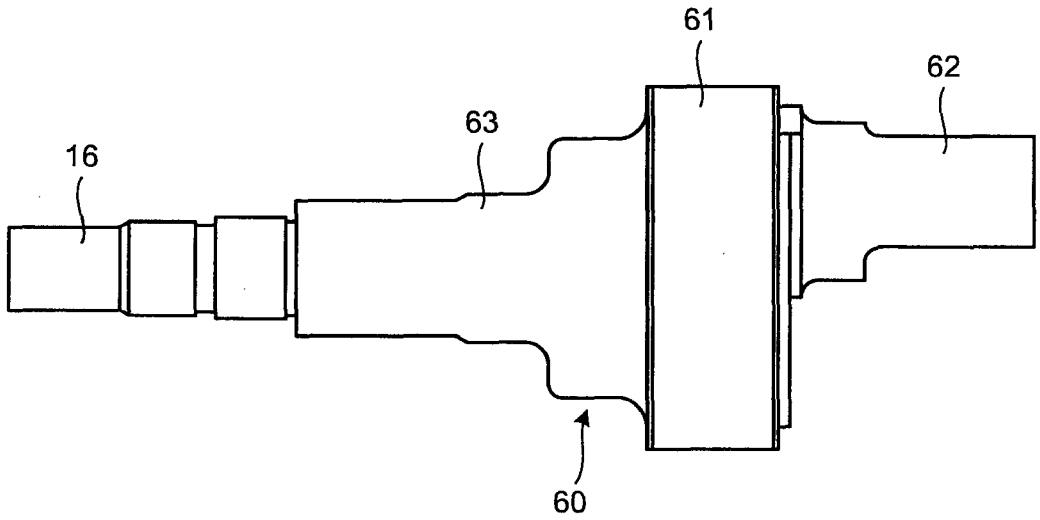
FIG. 4 is a front view of a portion of a crankshaft taken out from the scroll compressor according to the embodiment of the present invention.

As shown in FIGS. 1 and 4, the crankshaft 60 includes a circular column-like large diameter unit 61 at one end of a rotating shaft 16, and at a position eccentric by a predetermined amount from a shaft center of the rotating shaft 16 in the circular column-like large diameter unit 61, an eccentric shaft 62 projects so as to be in parallel with the rotating shaft 16.

In the crankshaft 60, adjacent to the side of the rotating shaft 16 of the circular column-like large diameter unit 61, a reinforced shaft unit 63 used to improve the rigidity is integrally formed.

As shown in FIG. 1, in the crankshaft 60 formed in this manner, a portion of the rotating shaft 16 is rotatably supported in the supporting unit 28 having a tubular small diameter, of the front case 21, via a small ball bearing 29. A portion of the circular column-like large diameter unit 61 is rotatably and pivotally mounted in the supporting unit 28 having a tubular large diameter, of the front case 21, via a large needle bearing 64.

The inner periphery of the front case 21 is fitted with a lip seal 31 made of rubber that prevents refrigerant gas from leaking, by blocking a gap between the rotating shaft 16 and the front case 21.

As shown in FIG. 1, at the outer peripheral side of the tip of the rotating shaft 16 of the crankshaft 60, the driving device 13 is disposed.

To form the driving device 13, at the tip of the rotating shaft 16 projecting from the supporting unit 28 of the front case 21, a rotating plate 32 is fixed thereto by a connecting bolt 33. At the outer periphery of the rotating plate 32, a support ring 34 in a ring shape is connected by a plurality of connecting pins 35.

An end surface of a driven pulley 36 is fixed to the support ring 34. The driven pulley 36 is rotatably supported by the supporting unit 28 of the front case 21, via a clutch bearing 37.

The driven pulley 36 includes therein an electromagnet 38 mounted therein, and a magnet clutch 105 is formed between the support ring 34 and the electromagnet 38. Although not shown, a driving belt of a belt transmission mechanism is wound around between the driven pulley 36 and an output shaft of a driving source (such as an engine), and the driven pulley 36 is rotated and driven by a rotation force of the driving source (such as an engine).

As shown in FIG. 1, in the scroll compressor main body 1, a space formed between the housing 11 and the compressing unit 12 is formed as an inlet chamber 39 linked to an inlet port 26 provided in the housing 11.

In the compressing unit 12, a compression chamber 40 is formed by defining a space by the fixed scroll 14 and the circling scroll 15.

A space formed between the rear case 22 and the fixed scroll 14 of the compressing unit 12 is formed as an outlet chamber 41 that is a high-pressure chamber. An outlet port (not shown) that is a through hole used to discharge high-pressure gas to the outside is formed in the outlet chamber 41.

The compressing unit 12 formed in this manner is a scroll compression mechanism formed by the fixed scroll 14 and the circling scroll 15. A function of the compressing unit 12 is to compress refrigerant gas sucked in from the inlet port 26 and to discharge resultant gas from the outlet port of the outlet chamber 41. Lubricating oil used to lubricate units in the housing 11 of the scroll compressor is vaporized and mixed with the refrigerant gas.

Figure 2:
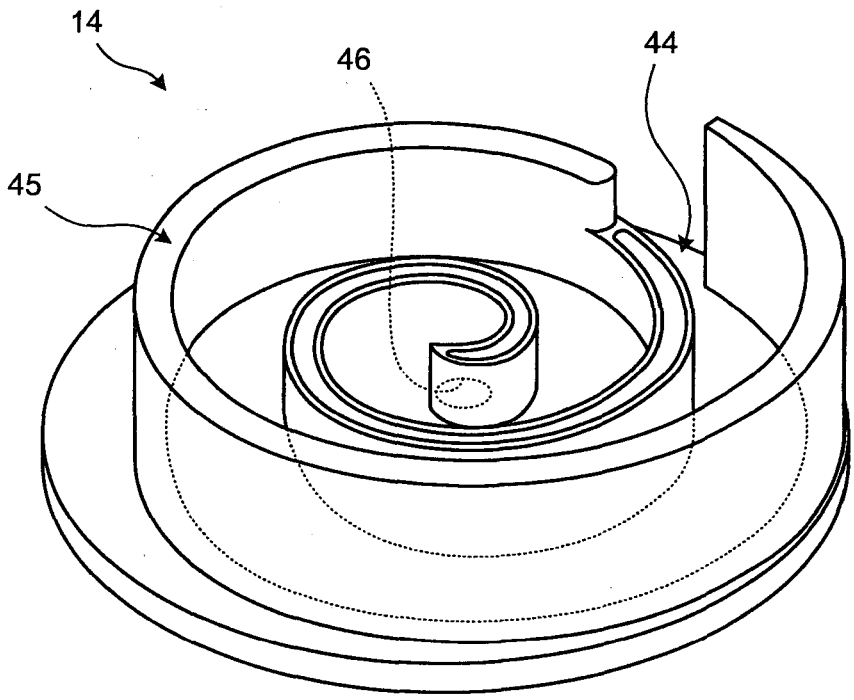
FIG. 2 is a perspective view of a portion of a fixed scroll taken out from the scroll compressor according to the embodiment of the present invention.

As is evident from FIGS. 1 and 2, the fixed scroll 14 includes a fixed side end plate 44 and a spiral lap 45 formed at one side of the fixed side end plate 44. The fixed scroll 14 is set so that the fixed side end plate 44 is fixed to the rear case 22 by a bolt 23A, and the spiral lap 45 faces the inside of the housing 11.

An outlet port 46 that connects the compression chamber 40 and the outlet chamber 41 is provided at the center of the fixed side end plate 44. The outlet port 46 is openable and closable by an outlet valve 47.

Figure 3:
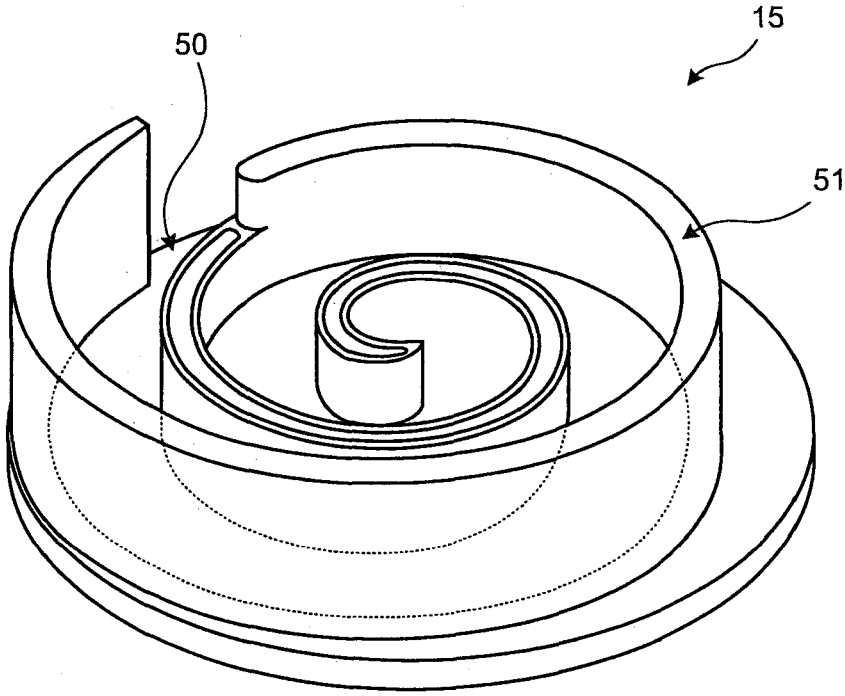
FIG. 3 is a perspective view of a portion of a circling scroll taken out from the scroll compressor according to the embodiment of the present invention.

As shown in FIGS. 1 and 3, the circling scroll 15 includes a circle side end plate 50 and a spiral lap 51 formed at one side of the circle side end plate 50.

The spiral lap 51 of the circling scroll 15 is combined with the spiral lap 45 of the fixed scroll 14, so as to mesh with each other, and the compression chamber 40 is defined by a space between the spiral laps (laps) 45 and 51.

As shown in FIG. 1, a boss 53 is provided on a surface at the side of the driving device 13 of the circle side end plate 50 in the circling scroll 15. In the boss 53, the driving bush 55 is rotatably mounted via a bearing 56.

The driving bush 55 is fitted with a balance weight 58 that cancels an unbalance amount produced by the circling scroll 15.

At the end surface of the driving bush 55, a slide hole 55A that extends in a predetermined direction is formed.

To form an anti-rotation mechanism of the circling scroll 15, an Oldham's coupling mechanism 57 is provided on a surface at the side of the driving device of the circle side end plate 50 of the circling scroll 15 (a surface opposite to the surface where the spiral lap 51 of the end plate is provided).

In this manner, when the circling scroll 15 is revolved to circle by an eccentric shaft 54 while the rotating shaft 16 is rotated, the rotation thereof is prevented by the rotation preventing mechanism (Oldham's coupling mechanism 57).

In the scroll compressor main body 1, a driving force transmission system that transmits a rotational driving force from the driving device 13 to the circling scroll 15 via the crankshaft 60 and the driving bush 55 is formed, and a variable circling radius mechanism is formed in the driving force transmission system.

To achieve this, in the scroll compressor main body 1, the eccentric shaft 62 of the crankshaft 60 is slidably inserted into the slide hole 55A of the driving bush 55.

In the driving force transmission system formed in this manner, when a driving force is transmitted from the driving source side to the rotating shaft 16 via the driving device 13, the rotating shaft 16 is rotated and makes the eccentric shaft 62 revolve. Accordingly, the eccentric shaft 62 makes the driving bush 55 linked thereto through the slide hole 55A revolve.

When the driving bush 55 is revolved in this manner, the circling scroll 15 integrated with the boss 53 that supports the driving bush 55 by the bearing 56 circles around the orbit, while having its rotation prevented by the rotation preventing mechanism.

In this manner, the circling scroll 15 continues to circle. Subsequently, refrigerant gas is sucked into the compression chamber 40 from the inlet port 26. In the scroll compressor main body 1, the compression chamber 40 is gradually narrowed. The refrigerant gas therein reaches the center portion while being compressed, and discharged to the outlet chamber 41 via the outlet port 46.

At this time, the outlet valve 47 is opened and closed by the differential pressure between the compression chamber 40 and the outlet chamber 41. In other words, if the pressure of the refrigerant gas in the compression chamber 40 becomes higher than the pressure in the outlet chamber 41, the compressed refrigerant gas pushes to open the outlet valve 47. Accordingly, a high-pressure refrigerant gas flows into the outlet chamber 41. The high-pressure refrigerant gas is then discharged outside via the outlet port (not shown) from the outlet chamber 41.

In the scroll compressor main body 1, when the compressing unit 12 compresses gas, the moment due to the reaction of gas pressure generated when gas is compressed, and the moment due to the centrifugal force of the members such as the circling scroll 15 and the balance weight 58 are generated.

For this reason, in the variable circling radius mechanism formed in the driving force transmission system of the scroll compressor main body 1, by using a vector component of the centrifugal force and the gas pressure force, the circling scroll 15 is moved in a direction (direction in which scroll teeth of the spiral lap 45 and the spiral lap 51 come close to each other and eliminate a gap) to increase the circling radius, when a driving center (center of the needle bearing 56) of the circling scroll 15 is circled.

In this manner, the variable circling radius mechanism advantageously maintains air tightness by pushing the spiral lap 51 of the circling scroll 15 to the spiral lap 45 of the fixed scroll 14.

As described above, the crankshaft 60 mounted on the scroll compressor main body 1 can be manufactured inexpensively at a high yield by a compression molding method for processing a material of the crankshaft by step-by-step cold forging.

To achieve this, SCM415 steel or a material corresponding thereto that has mechanical characteristics (such as processing characteristics) is used as a material for the crankshaft 60.

Figure 5:
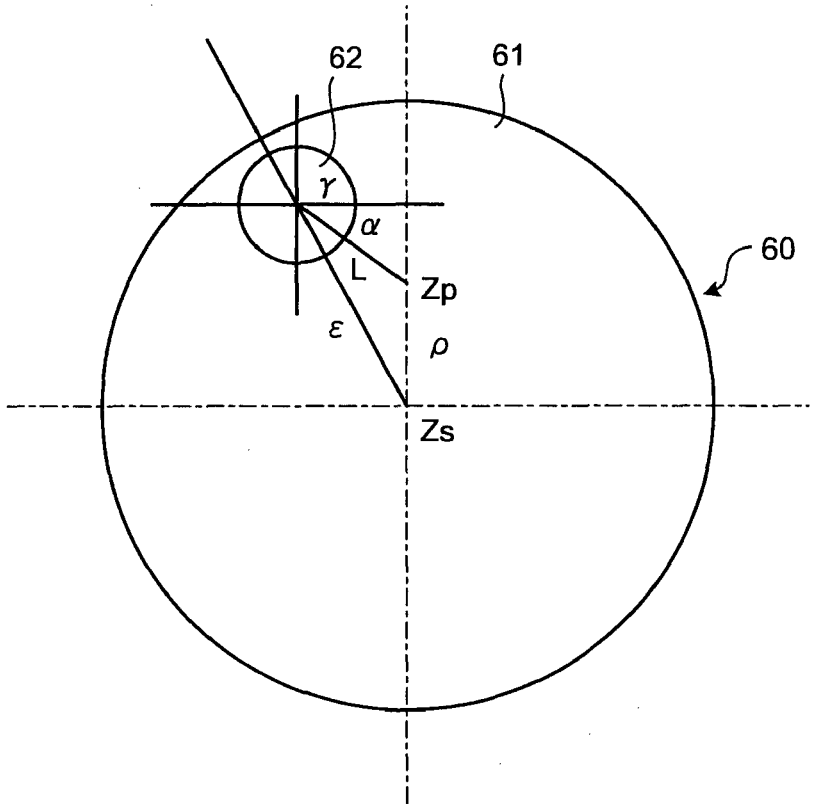
FIG. 5 is a schematic for explaining an eccentricity ratio f of an eccentric shaft to a rotating shaft in the crankshaft according to the embodiment of the present invention.

As shown in FIG. 5, in the crankshaft 60, an eccentricity ratio f of the eccentric shaft 62 to the rotating shaft 16 is set to f=r/L=(approximately 1 to 2, in other words, $1 \leqq f \leqq 2$).

Here, f=r/L is calculated using the following formula:

$$L=\sqrt{\epsilon^2-\rho^2\cos^2\alpha}-\rho\sin\alpha \qquad \text{[Expression 1]}$$

Here, f indicates an eccentricity ratio of the eccentric shaft 62, r indicates a radius of the eccentric shaft 62, L indicates a distance between the center of and the driving center of the eccentric shaft 62, $\epsilon$ indicates an eccentric amount of the eccentric shaft 62, $\rho$ indicates a circling radius, and $\alpha$ indicates an angle at which the eccentric shaft 62 is set. Zp is the driving center, and Zs is the center of the circular column-like large diameter unit 61 of the crankshaft 60.

When the crankshaft 60 is formed at f=1 to 2 ($1 \leqq f \leqq 2$), it is possible to improve the yield of the molding process using cold forging, and also to manufacture inexpensively.

Being reinforced by providing the reinforced shaft unit 63, the crankshaft 60 is mounted on the scroll compressor main body 1, by having a portion of the large-sized circular column-like large diameter unit 61 supported by the large needle bearing 64, which is less expensive than a large ball bearing.

In other words, in the scroll compressor main body 1, the needle bearing 64, which is inexpensive even if it is large, is used for supporting. As a result, it is possible to provide an inexpensive product.

In the crankshaft 60, when a driving force entered from the rotating shaft 16 is output from the eccentric shaft 62, the entire crankshaft 60 is elastically deformed, so that the side of the eccentric shaft 62 is inclined towards the direction of the center line of the rotating shaft 16.

The crankshaft 60 is formed so that a deflection amount towards the side of the eccentric shaft 62 in the entire crankshaft 60 at this time is reduced by the reinforced shaft unit 63. Because of the deflection towards the side of the eccentric shaft 62, it is possible to mitigate the crankshaft 60 from coming into partial contact with the needle bearing 64 that rotatably receives the circular column-like, large diameter unit 61.

Accordingly, in the scroll compressor main body 1, a portion of the needle bearing 64 is prevented from being damaged, for example, due to biased wear and concentrated stress. As a result, it is possible to improve the reliability on the portion of the needle bearing 64, by giving longer usage life to the portion of the needle bearing 64, thereby improving the quality of the product.

In the scroll compressor main body 1, the rigidity of the portion of the reinforced shaft unit 63 in the crankshaft 60 is improved so that the variable circling radius mechanism can stably function as a gap seal in a radial direction for eliminating a gap between the scroll teeth.

To achieve this, in the crankshaft 60, the size (diameter and width) of the reinforced shaft unit 63 is set so that the deflection amount of the crankshaft 60 towards the side of the eccentric shaft 62 falls within an acceptable range to stably operate the variable circling radius mechanism.

At this time, if the diameter of the reinforced shaft unit 63 of the crankshaft 60 is set to have the same diameter as that of a round bar-like steel that is a material of the crankshaft 60, it is possible to reduce the number of process steps for forming an exterior of the portion of the reinforced shaft unit 63, when the crankshaft 60 is manufactured by a cold forging process. As a result, it is possible to reduce the manufacturing cost.

The present invention is not limited to the above-described embodiments, and other various configurations may be employed within the spirit and scope of the present invention.

INDUSTRIAL APPLICABILITY

As described above, the scroll fluid machine according to the present invention can be advantageously used for a scroll fluid machine aimed at reducing cost.

The invention claimed is:

1. A scroll fluid machine comprising:

a crankshaft that makes a circling scroll revolve to circle around a fixed scroll fixed inside a housing; and a variable circling radius mechanism that, by pushing the circling scroll to the fixed scroll, seals a compression chamber defined by the fixed scroll and the circling scroll in a radial direction, wherein the crankshaft includes a reinforced shaft section, a circular column-like large diameter section, and an eccentric shaft section, the reinforced shaft section having a predetermined diameter is provided continuously at a driving device side of the circular column-like large diameter section of the crankshaft, and a material is produced by a step-by-step cold forging process by setting the eccentric shaft section projecting from the circular column-like large diameter section at a predetermined eccentricity ratio f from a rotation axis of the crankshaft, the circular column-like large diameter section of the crankshaft is rotatably coupled to the housing via a needle bearing, the predetermined diameter of the reinforced shaft section is set so that a deflection amount towards a side of the eccentric shaft-section, while transmitting a driving force by the crankshaft, falls within an acceptable range to stably operate the variable circling radius mechanism, and the eccentricity ratio f of the crankshaft is calculated by a following formula, and the eccentricity ratio f is set to $1 \leqq f \leqq 2$:

$f=r/L$, where:

$$L=\sqrt{\epsilon^2-\rho^2\cos^2\alpha}-\rho\sin\alpha$$

where f indicates the eccentricity ratio of the eccentric shaft section, r indicates a radius of the eccentric shaft section, L indicates a distance between a center of the eccentric shaft section and a driving center of the circular column-like large diameter section, $\epsilon$ indicates an eccentric amount of the eccentric shaft section, $\rho$ indicates a circling radius, and $\alpha$ indicates an angle at which the eccentric shaft section is set.

2. The scroll fluid machine according to claim 1, wherein the crankshaft is produced by a cold forging process using SCM415 steel.

3. The scroll fluid machine according to claim 1, wherein the crankshaft is produced by a cold forging process using a round bar-like material that has a same diameter as the diameter of the reinforced shaft section.

* * * * *